US006761466B1

(12) United States Patent
Cheng

(10) Patent No.: US 6,761,466 B1
(45) Date of Patent: Jul. 13, 2004

(54) ELASTIC FLASH STICK WITH AN ORNAMENTAL BLOCK

(76) Inventor: Chen-An Cheng, No. 33, Lane 340, Section 1, Hai Tian Road, Tainan (TW)

( * ) Notice: Subject to any disclaimer, the term of this patent is extended or adjusted under 35 U.S.C. 154(b) by 20 days.

(21) Appl. No.: 10/339,390

(22) Filed: Jan. 10, 2003

(51) Int. Cl.[7] ..... F21L 4/00

(52) U.S. Cl. ..... 362/189; 362/109; 362/198; 362/806; 446/242

(58) Field of Search ..... 362/186, 190, 362/122, 121, 109, 189, 198, 102, 577, 800, 806, 807, 253; 446/175, 242, 438, 439, 485

(56) References Cited

U.S. PATENT DOCUMENTS 4,495,550 A * 1/1985 Visciano ..... 362/189

5,266,063 A * 11/1993 Baumgartner, Jr. ..... 446/242

* cited by examiner

*Primary Examiner*—Bao Q. Truong
(74) *Attorney, Agent, or Firm*—Rosenberg, Klein & Lee

(57) ABSTRACT

An elastic flash stick with an ornamental block is assembled by a holding rod, an elastic stem, a turning switch kit and an ornamental block. The holding rod is provided with an inserting end on the top to be secured to the bottom end of the elastic stem. The elastic stem is made of elastic coil or material of elasticity. The turning switch kit is provided with a connecting base at the bottom to receive the turning pivot, a plurality of batteries are provided to the top of the turning pivot, and at least one flickering diode is provided in the top end of the turning switch kit. The at least one flickering diode as well as the top end of the turning switch kit is covered by the replaceable ornamental block so as to achieve vivid and aesthetic effects.

4 Claims, 6 Drawing Sheets

ELASTIC FLASH STICK WITH AN ORNAMENTAL BLOCK

BACKGROUND OF THE INVENTION

1. Field of the Invention

The present invention relates to an elastic flash stick. The present invention relates, more particularly, to an elastic flash stick which is provided with a replaceable ornamental block on the top to achieve vivid and aesthetic effects.

2. Description of the Related Art

As various kinds of night activities are in fashion, flash sticks are more and more frequently used by people, especially by youngsters. There are various kinds of flash sticks in the market for users to choose.

Referring to FIGS. 1 and 2, the flash stick 10 is the most popular one. It is composed by an outer tube 101 and a plurality of inner tubes 102. The outer tube 101 is transparent and provided with a center hollow room for receiving the inner tubes 102 and catalyzer 101A. Both end openings of the outer tube 101 are respectively sealed by a tap 1011. Each inner tube 102 is transparent and fragile, the bottom end 1021 of each inner tube 102 is closed, and the other end 1022 of each inner tube 102 is formed as a connecting section. The interior of each inner tube 102 is filled with oxalate 102A of different colors.

While being used, the assembled inner tubes 102 are inserted through one end opening of the outer tube 101 into the center hollow room of the outer tube 101, and then the end opening is sealed by a tap 1011. When the flash stick 10 is bent to make the inner tubes 102 be broken, the colorful oxalate 102A in the inner tubes 102 will flow out to mix with catalyzer 101A in the center hollow room so as to produce the colorful flash effect, referring to FIG. 3.

However, there are many drawbacks in the above-mentioned related flash stick. The inner tubes can not be used again after they are broken. The colorful flash effect produced by the mixture of oxalate and catalyzer can not last a long time. The conventional shape of the outer tube is dull and not attractive.

SUMMARY OF THE INVENTION

Accordingly, the present invention is directed to an elastic flash stick with a ornamental block that can substantially obviate the drawbacks of known flash sticks and enhance the aesthetic and vivid effects beyond those of conventional flash sticks.

An object of the present invention is to provide an elastic flash stick with a ornamental block which can be repeatedly used for a long time and for the purpose of lightening the night and attracting attention in the dark.

Another object of the present invention is to provide an elastic flash stick which is provided with a replaceable ornamental block secured to the top so as for the flash stick to look vivid and attractive.

Yet another object of the present invention is to provide an elastic flash stick with an ornamental block which will swing rhythmically by the wave of a user.

To achieve these advantages, an elastic flash stick with an ornamental block in the present invention is assembled by a holding rod, an elastic stem, a turning switch kit and an ornamental block. The holding rod is provided with an inserting end on the top to be secured to the bottom end of the elastic stem. The elastic stem is made of elastic coil or material of elasticity. The turning switch kit is provided with a connecting base at the bottom to receive the turning pivot, a plurality of batteries are provided to the top of the turning pivot, and at least one flickering diode is provided in the top end of the turning switch kit. The at least one flickering diode as well as the top end of the turning switch kit is covered by the replaceable ornamental block so as to achieve vivid and aesthetic effects.

BRIEF DESCRIPTION OF THE DRAWINGS

The many features and advantages of the present invention will become apparent in the following detailed description of the preferred embodiments with reference to the accompanying drawings, in which.

DETAILED DESCRIPTION OF THE PREFERRED EMBODIMENTS

Figure 1:
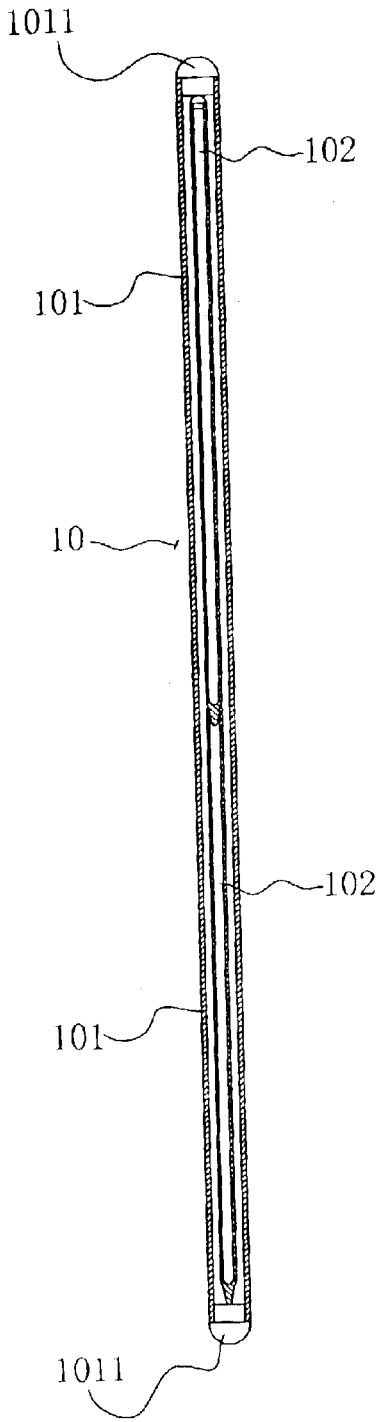
FIG.1 (PRIOR ART)
FIG. 1 is a perspective view of a conventional flash stick in assembled configuration.
Figure 2:
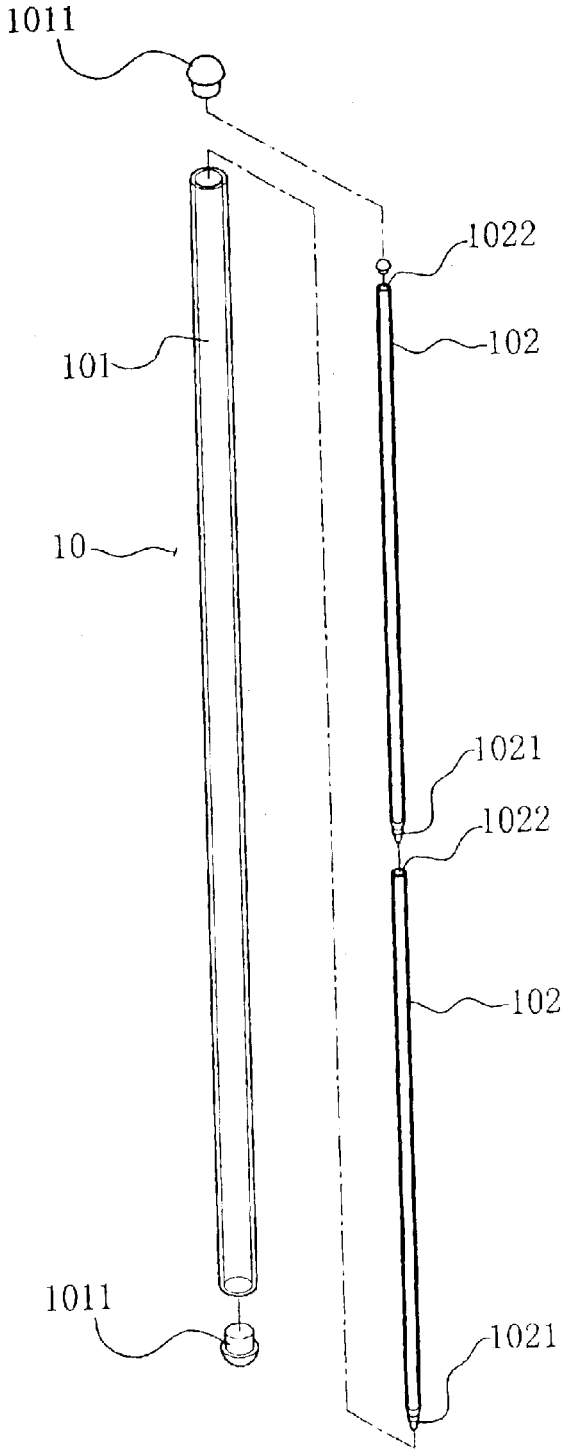
FIG.2 (PRIOR ART)
FIG. 2 is a perspective exploded view of a conventional flash stick.
Figure 3:
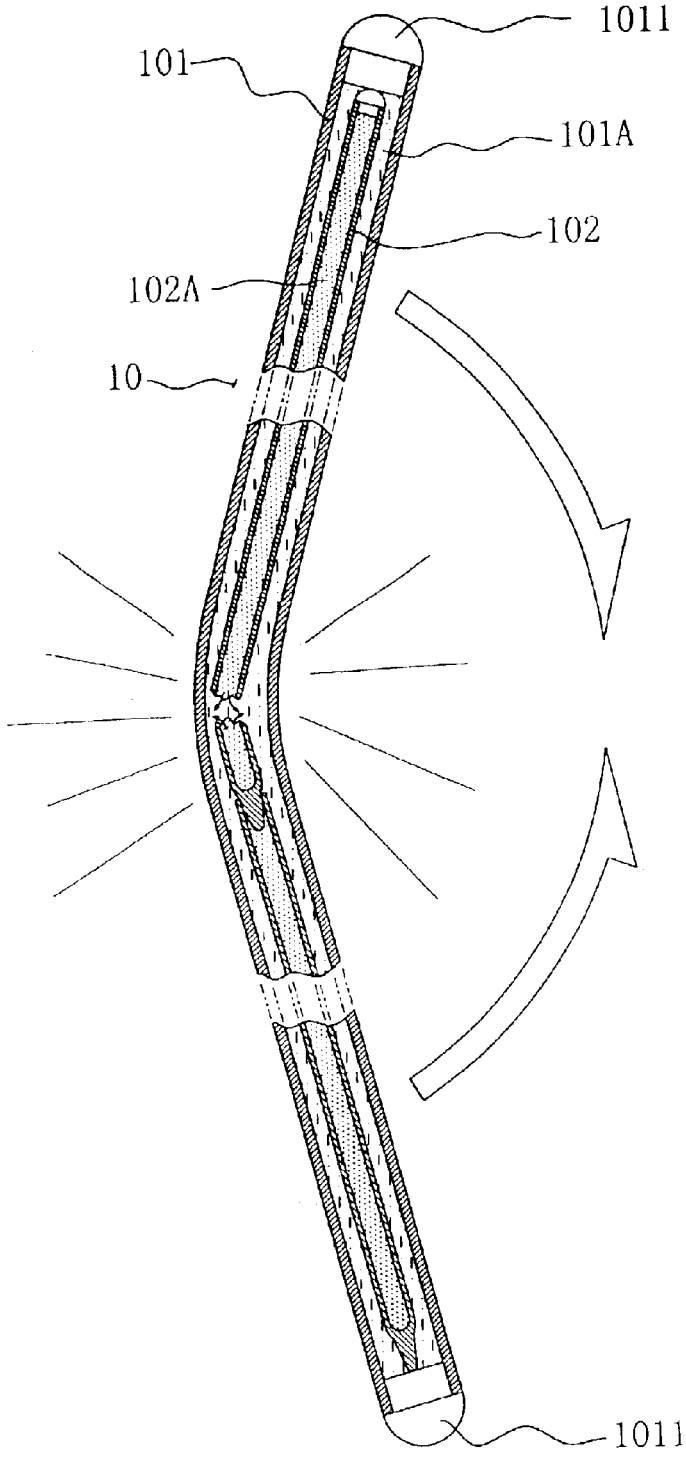
FIG. 3 (PRIOR ART)
FIG. 3 is a schematic sectional view of a conventional flash stick in assembled configuration.
Figure 4:
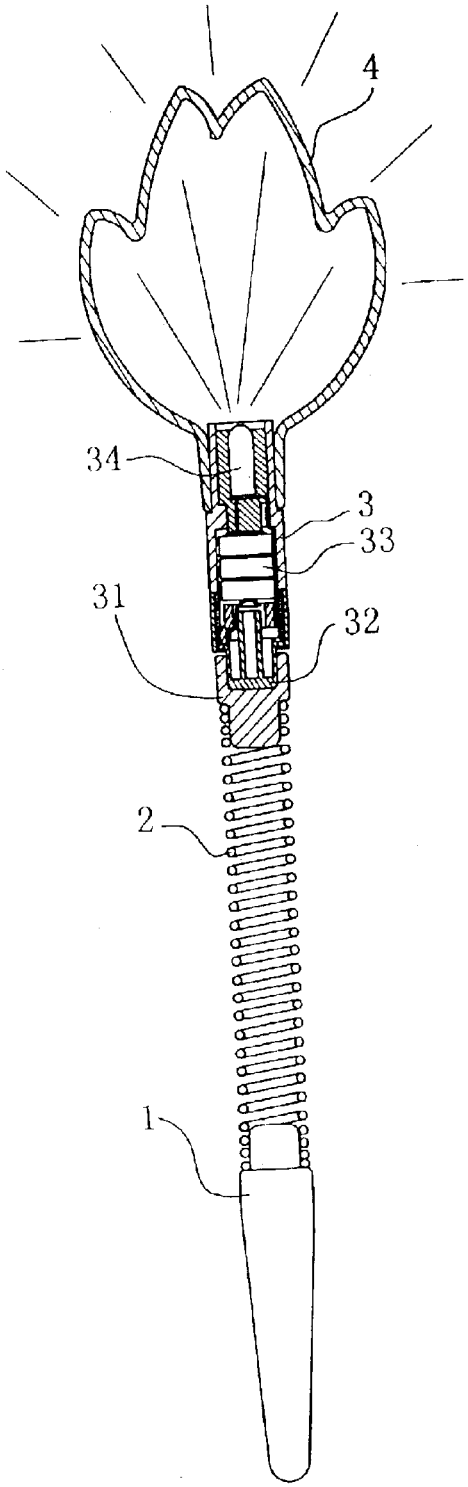
FIG. 4 is a sectional view of an embodiment of an elastic flash stick in assembled configuration in accordance with the present invention.
Figure 5:
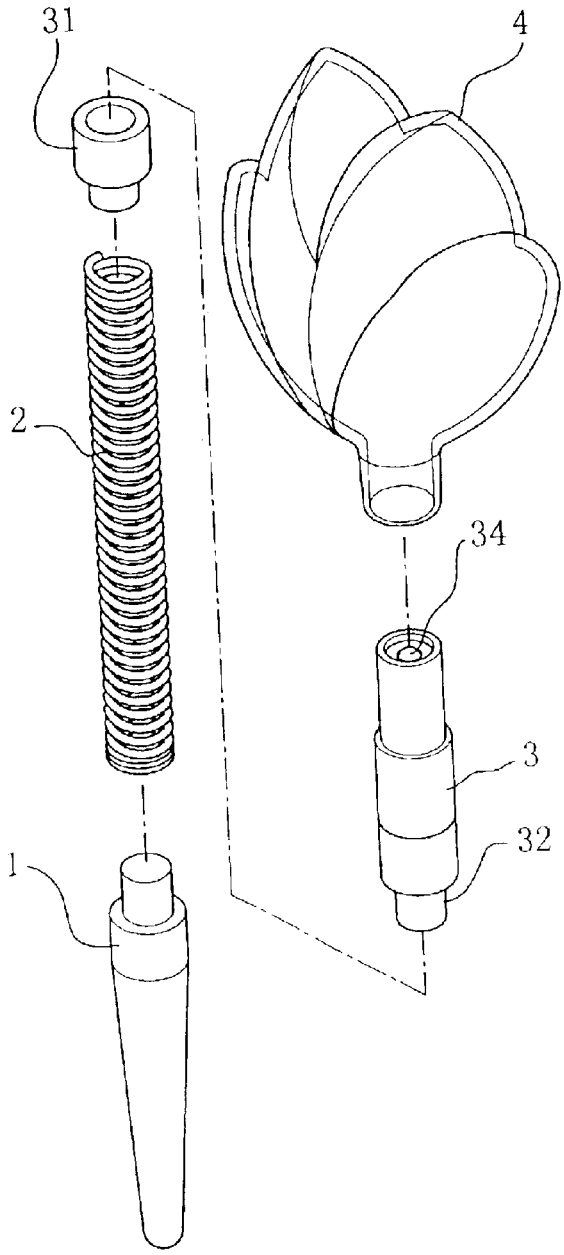
FIG. 5 is a perspective exploded view of an embodiment of an elastic flash stick in accordance with the present invention.

Referring to FIGS. 4 and 5, a preferred embodiment of an elastic flash stick with an ornamental block in the present invention is assembled by a holding rod 1, an elastic stem 2, a turning switch kit 3 and an ornamental block 4.

The holding rod 1 is provided with an inserting end on the top to be secured to the bottom end of the elastic stem 2.

The elastic stem 2 is made of elastic coil or material of elasticity.

Figure 6:
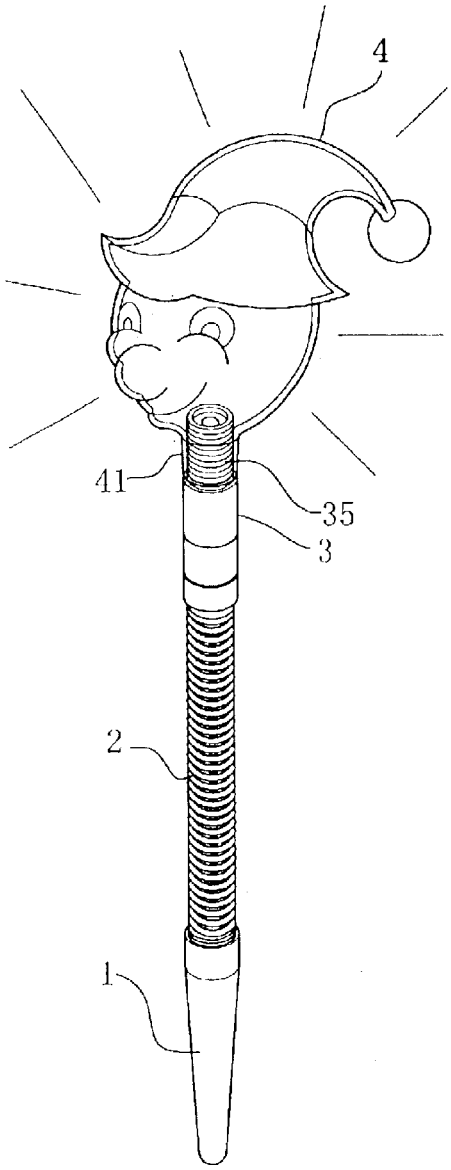
FIG. 6 is a perspective view of an elastic flash stick provided with another configuration of ornamental block in accordance with the present invention.

The turning switch kit 3 is provided with a connecting base 31 at the bottom to receive the turning pivot 32, a plurality of batteries 33 are provided to the top of the turning pivot 32, and at least one flickering diode 34 is provided in the top end of the turning switch kit 3. The top end of the turning switch kit 3 may be a screwing section 35, as shown in FIG. 6. The at least one flickering diode 34 as well as the top end of the turning switch kit 3 is covered by the replaceable ornamental block 4.

Figure 7:
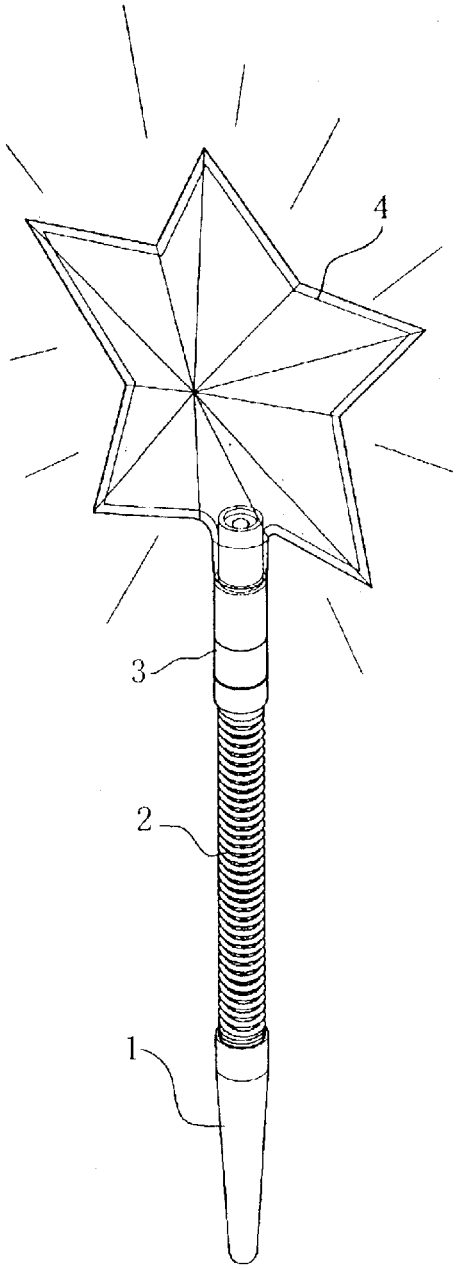
FIG. 7 is a perspective view of an elastic flash stick provided with yet another configuration of ornamental block in accordance with the present invention.
Figure 8:
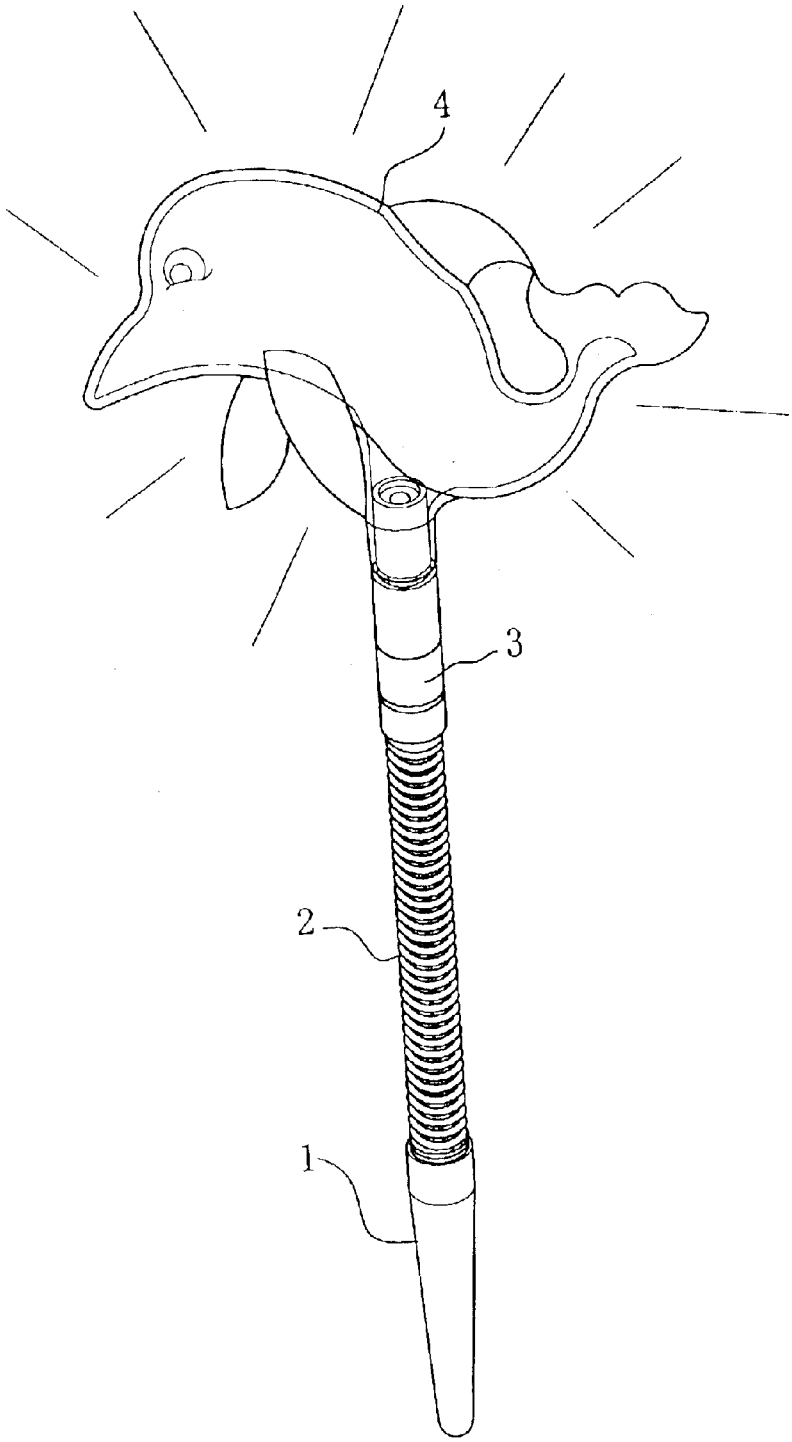
FIG. 8 is a perspective view of an elastic flash stick provided with a further configuration of ornamental block in accordance with the present invention; and, FIG. 9 is a schematic sectional view of an embodiment of an elastic flash stick in accordance with the present invention while being used.

The ornamental block 4 is transparent and may be any kind of configuration, such as a star, a flower, a Santa Claus, a dolphin, as shown in FIGS. 6, 7 and 8. The bottom of the ornamental block 4 is provided with a connecting section, The connecting section may be a screwing section 41, as shown in FIG. 6.

While being assembled, the elastic stem 2 is firmly secured to the top end of the holding rod 1, the connecting base 31 of the turning switch kit 3 is secured to the top end of the elastic stem 2, and then the ornamental block 4 is secured to the top end of the turning switch kit 3 by screwing, referring to FIG. 6, or alternatively by gluing, referring to FIG. 7.

Figure 9:
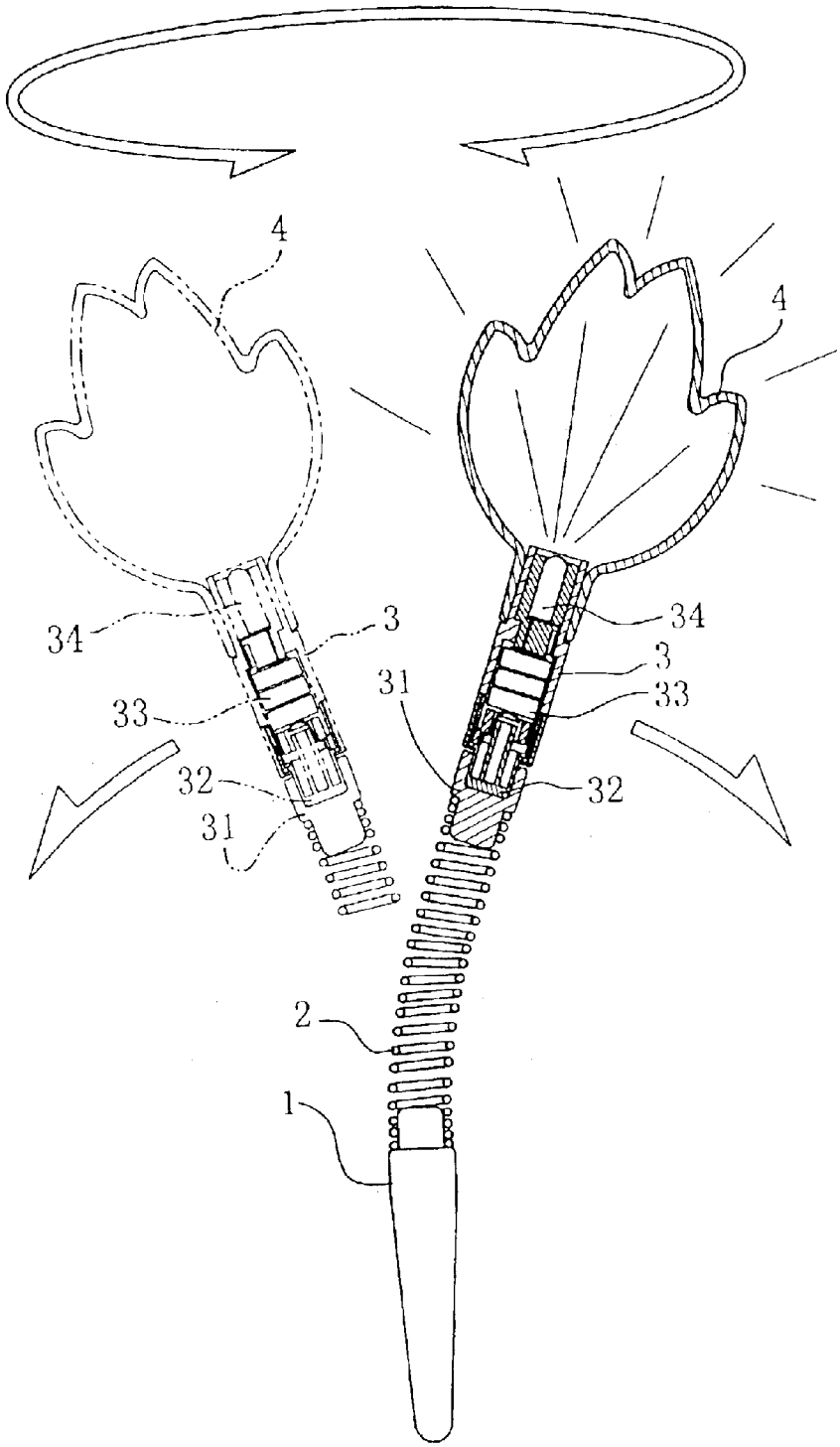

Referring to FIG. 9, while being applied, a preferable configuration of ornamental block 4 may be chosen and Replaced by user for the elastic flash stick of the present invention, and then the turning pivot 32 is turned to switch on the at least one flickering diode 34 in the top end of the turning switch kit 3 so as to make the at least one flickering diode 34 keep flickering and to let the elastic flash stick look vivid and shining. While being waved by the user, the ornamental block 4 as well as the turning switch kit 3 will swing or turn through the elasticity of the elastic stem 2.

While the preferred embodiments of the invention have been described above, it will be recognized and understood that various modifications may be made thereto, and the appended claims are intended to cover all such modifications which may fall within the spirit and scope of the invention.

What is claimed is:

1. An elastic flash stick with an ornamental block comprising:

a holding rod being provided with an inserting end on the top;

an elastic stem being made of elastic coil or material of elasticity, the bottom end of said elastic stem being secured to the top end of said holding rod;

a turning switch kit being provided with a connecting base at the bottom to receive a turning pivot, a plurality of batteries being provided to the top of said turning pivot, at least one flickering diode being provided in the top end of said turning switch kit, said at least one flickering diode as well as the top end of said turning switch kit being covered by said replaceable ornament block; and, said ornament block being transparent and provided with a connecting section at the bottom to secure to the top of said turning switch kit.

2. An elastic flash stick with an ornamental block as recited in claim 1, wherein the top end of said turning switch kit may be a screwing section.

3. An elastic flash stick with an ornamental block as recited in claim 2, wherein said connecting section at the bottom of said ornamental block may be a screwing section.

4. An elastic flash stick with an ornamental block as recited in claim 3, wherein said ornamental block may be any kind of configuration, including a star, a flower, a Santa Claus, a dolphin.

* * * * *